US009913505B1

(12) United States Patent
Wilson

(10) Patent No.: US 9,913,505 B1
(45) Date of Patent: Mar. 13, 2018

(54) SHIRT STAY SUSPENDERS WITH QUICK RELEASE BUCKLES

(71) Applicant: Dwane Wilson, Woodstock, GA (US)

(72) Inventor: Dwane Wilson, Woodstock, GA (US)

( * ) Notice: Subject to any disclaimer, the term of this patent is extended or adjusted under 35 U.S.C. 154(b) by 0 days.

(21) Appl. No.: 15/181,531

(22) Filed: Jun. 14, 2016

(51) Int. Cl.
*A41F 3/00* (2006.01)
*A41F 17/00* (2006.01)

(52) U.S. Cl.
CPC ..... *A41F 17/00* (2013.01); *A41F 3/00* (2013.01)

(58) Field of Classification Search
CPC ..... A41F 3/00; A41F 3/02
See application file for complete search history.

(56) References Cited

U.S. PATENT DOCUMENTS 1,570,492 A * 1/1926 Jackson ..... A41F 3/00 2/313
1,680,629 A * 8/1928 Norwood ..... A41F 3/00 2/328
4,937,886 A 7/1990 Ellis
5,177,813 A 1/1993 Bosack
5,230,451 A * 7/1993 Onozawa ..... A45F 3/14 2/300
5,276,923 A 1/1994 Cohen
D349,180 S 8/1994 Oldham
5,375,279 A * 12/1994 Toso ..... A47C 16/00 5/633
5,643,184 A * 7/1997 Toso ..... A47C 16/00 2/44
6,213,922 B1 * 4/2001 Afanasenko ..... A61F 5/01 482/121
6,959,455 B2 * 11/2005 Hall ..... A41F 19/00 2/340
D595,930 S 7/2009 Perry
9,049,895 B1 6/2015 Wesol
9,339,071 B2 * 5/2016 Herman ..... A41F 3/02
2013/0247280 A1 9/2013 Haggard
2015/0101109 A1 4/2015 Herman
2015/0135395 A1 5/2015 Galil

* cited by examiner

*Primary Examiner* — Tejash Patel
(74) *Attorney, Agent, or Firm* — Kyle A. Fletcher, Esq.

(57) ABSTRACT

The shirt stay suspenders with a quick release buckle is adapted for use with a shirt. The shirt stay suspenders with a quick release buckle is an apparel stay that is used to hold a shirt in position while it is worn by a wearer. The shirt stay suspenders with a quick release buckle is worn underneath the outer apparel layer of the wearer such that the shirt stay suspenders with a quick release buckle will not been seen. From this location, the shirt stay suspenders with a quick release buckle attaches the shirt of the wearer to the foot of the wearer such that the shirt will remain in position and not become what is commonly referred to as "untucked". The shirt stay suspenders with a quick release buckle comprises a plurality of stays. Each of the plurality of stays further comprises a first strap, a second strap, and a quick release buckle.

8 Claims, 2 Drawing Sheets

SHIRT STAY SUSPENDERS WITH QUICK RELEASE BUCKLES

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of apparel and accessories for apparel, more specifically, an accessory adapted for use in holding apparel in place.

Summary of Invention

The shirt stay suspenders with a quick release buckle is adapted for use with a shirt. The shirt stay suspenders with a quick release buckle is an apparel stay that is used to hold a shirt in position while it is worn by a wearer. The shirt stay suspenders with a quick release buckle is worn underneath the outer apparel layer of the wearer such that the shirt stay suspenders with a quick release buckle will not been seen. From this location, the shirt stay suspenders with a quick release buckle attaches the shirt of the wearer to the foot of the wearer such that the shirt will remain in position and not become what is commonly referred to as "untucked".

These together with additional objects, features and advantages of the shirt stay suspenders with a quick release buckle will be readily apparent to those of ordinary skill in the art upon reading the following detailed description of the presently preferred, but nonetheless illustrative, embodiments when taken in conjunction with the accompanying drawings.

In this respect, before explaining the current embodiments of the shirt stay suspenders with a quick release buckle in detail, it is to be understood that the shirt stay suspenders with a quick release buckle is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the shirt stay suspenders with a quick release buckle.

It is therefore important that the claims be regarded as including such equivalent construction insofar as they do not depart from the spirit and scope of the shirt stay suspenders with a quick release buckle. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
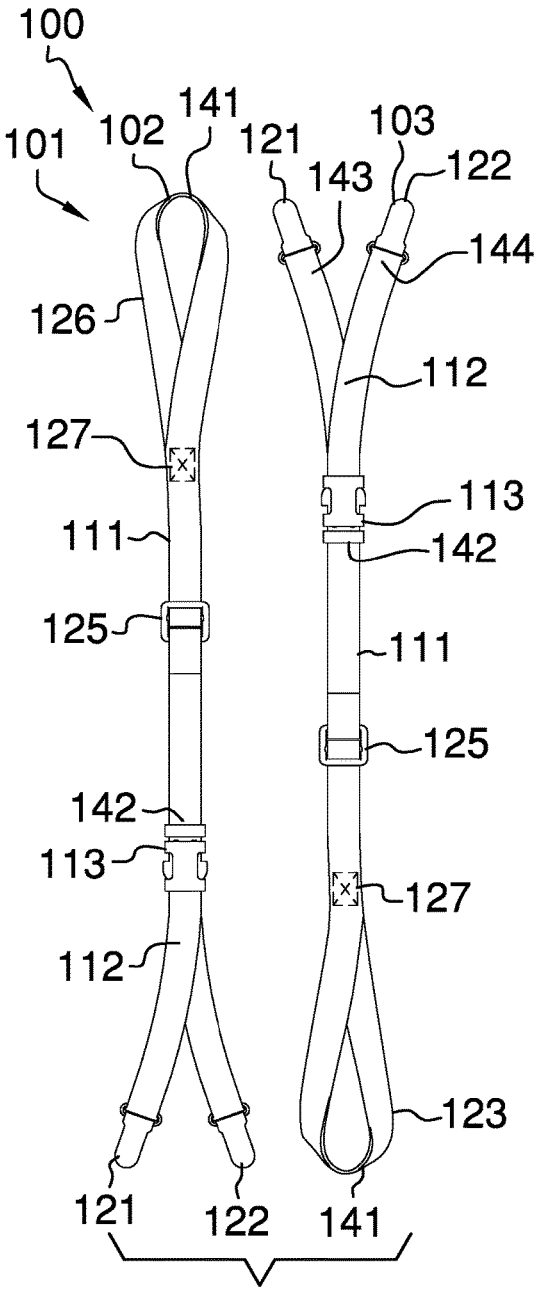
FIG. 1 is a front view of an embodiment of the disclosure.
Figure 2:
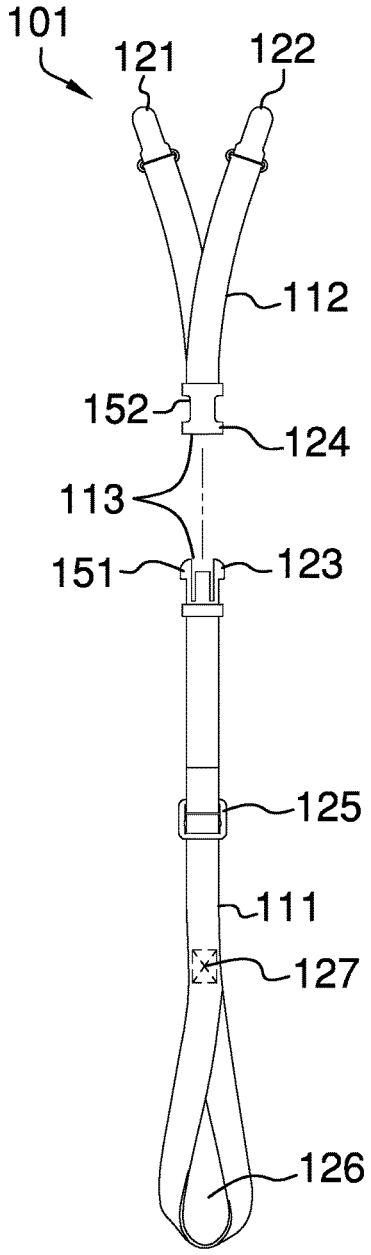
FIG. 2 is an exploded view of an embodiment of the disclosure.
Figure 3:
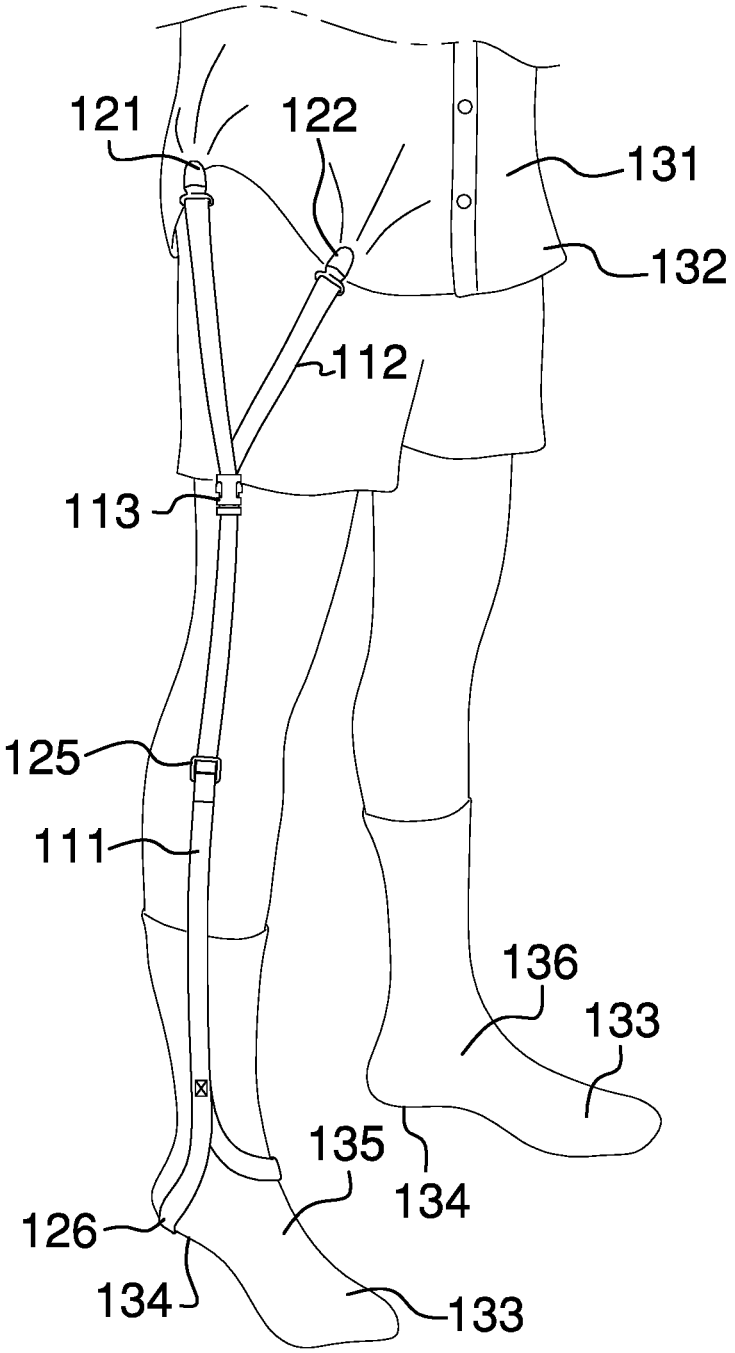
FIG. 3 is an in use view of an embodiment of the disclosure.

Detailed reference will now be made to one or more potential embodiments of the disclosure, which are illustrated in FIGS. 1 through 3.

The shirt stay suspenders with a quick release buckle 100 (hereinafter invention) comprise a plurality of stays 101. Each of the plurality of stays 101 further comprises a first strap 111, a second strap 112, and a quick release buckle 113. The invention 100 is adapted for use with a shirt 132. The invention 100 is an apparel stay that is used to hold a shirt 132 in position while it is worn by a wearer 131. The invention 100 is worn underneath the outer layer of apparel of the wearer such that the invention 100 will not been seen by other persons. From this location, the invention 100 attaches the shirt 132 of the wearer 131 to the foot 133 of the wearer 131 such that the shirt 132 will remain in position and not become what is commonly referred to as "untucked".

The first strap 111 is a commercially available webbing. The second strap 112 is a commercially available webbing. The first strap 111 is further defined with a first end 141 and a second end 142. The second strap 112 is further defined with a third end 143 and a fourth end 144. The first strap 111 may be formed from an elastic or a non elastic webbing. The second strap 112 may be formed from an elastic or a non elastic webbing. It is preferred that the first strap 111 and the second strap 112 be formed from elastic webbings. The use of elastic webbings allows each of the plurality of stays 101 to adjust more readily and naturally to the movements of the wearer 131. The quick release buckle 113 is a commercially available quick release buckle 113 that further comprises a male connector 123 and a female connector 124. The quick release buckle 113 is selected such that the quick release buckle 113 further comprises a ring and slider arrangement 125.

The first end 141 of the first strap 111 is folded back upon the body of the first strap 111 such that a loop 126 is formed. The loop 126 is sized such that the foot 133 of the wearer 131 can be inserted into the loop 126. The first end 141 is attached to the body of the first strap 111 using a seam 127. Potential methods to form seams include, but are not limited to, sewn seams, heat bonding, or ultrasonic bonding. It is preferred that a sewn seam be used for the seam 127. The second end 142 of the first strap 111 is fitted with a first member 151 selected from the group consisting of the male connector 123 of the quick release buckle 113 and the female connector 124 of the quick release buckle 113. The element selected to be the first member 151 is the element that contains the ring and slider arrangement 125 of the quick release buckle 113. The ring and slider arrangement 125 is a device that adjusts the effective length of the first strap 111 to a length such that a tension is applied to the first strap 111 while the invention 100 is being worn. This tension is transferred through the quick release buckle 113 to the second strap 112, which holds the shirt 132 in position. Methods to install quick release buckles and ring and slider arrangements to the end of a webbing are well known and documented in the apparel arts.

The second strap 112 further comprises a second member 152, a first clip 121 and a second clip 122. The second strap 112 is attached to a second member 152. The second member 152 is the element of the group consisting of the male connector 123 of the quick release buckle 113 and the female connector 124 of the quick release buckle 113 that was not selected to be the first member 151. The second member 152 is attached to the second strap 112 such that the position of the second member 152 is adjustable such that the second member 152 can be positioned anywhere along the second strap 112. The first clip 121 is a commercially available clip that attaches to the third end 143 of the second strap 112. The second clip 122 is a commercially available clip that attaches to the fourth end 144 of the second strap 112. The purpose of the first clip 121 is to attach the third end 143 of the second strap 112 to the textile that forms the shirt 132. The purpose of the second clip 122 is to attach the fourth end 144 of the second strap 112 to the textile that forms the shirt 132.

To use a stay selected from the plurality of stays 101, the first clip 121 is attached to the textile that forms the shirt 132. The second clip 122 is attached to the textile that forms the shirt 132. The foot 133 of the wearer 131 is placed through the loop 126 such that the loop 126 is under the heel 134 of the foot 133 when the wearer 131 is standing formally. The ring and slider arrangement 125 is adjusted such that tension is applied to the first strap 111 and the second strap 112 while the invention 100 is being used. The second member 152 and the first member 151 are connected together to complete the attachment of the quick release buckle 113. The second member is then moved along the second strap 112 to a position wherein the tension applied to the first clip 121 and the second clip 122 are the same.

The use of the invention 100, the plurality of stays 101 comprises a first stay 102 and a second stay 103. As shown most clearly in FIG. 3, the loop 126 of the first stay 102 is placed around the right 135 foot 133 of the wearer 131. The second stay 103 is worn in the same manner except that the second stay 103 is placed around the left 136 foot 133 of the wearer 131.

The following definitions were used in this disclosure:

Buckle: As used in this disclosure, a buckle is a fastening that is used for joining a first loose end of a strap to a second loose end of the same strap or a different strap. A buckle further comprises a male connector that is attached to a first loose end and a female connector that is attached to a second loose end. The male connector has a pin or other structure that is generally caught by a structure formed in the female connector.

Quick Release Buckle: As used in this disclosure, a quick release buckle is a specific type of buckle wherein the buckle can be readily and easily disconnected by pressing a button or pinching one of the ends of the quick release buckle. Quick release buckles are readily and commercially available.

Clip: As used in this disclosure, a clip is a fastener that attaches to an object by gripping or clasping the object.

Elastic: As used in this disclosure, an elastic is a material or object that deforms when a force is applied to it and that is able to return to its original shape after the force is removed. A material that exhibits these qualities is also referred to as an elastomeric material.

Elastic Webbing: As used in this disclosure, an elastic webbing is a webbing that contains elastic yarns as some of the yarns that make up the webbing. An elastic webbing is constructed such that the elastic webbing will stretch when a force is applied and will return to its original shape when after the force is removed.

Elastic Yarn: As used in this disclosure, an elastic yarn is a yarn formed from elastomeric materials.

Fastener: As used in this disclosure, a fastener is a device that is used to join or affix two objects. Fasteners generally comprise a first element, which is attached to the first object and a second element which is attached to the second object such that the first element and the second element join to affix the first object and the second object.

Loop: As used in this disclosure, a loop is the length of a first linear structure including, but not limited to, lines, cords, or ribbons, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure.

Ring and Slider Arrangement: As used in this disclosure, a ring and slider arrangement is an apparatus comprising a ring component and a slider component that is used to adjust the effective length of a webbing in an application. In the ring and slider arrangement, an end of the webbing is inserted through the slider component, looped through the ring component and then reverse threaded through the slider component for a second time. By adjusting the position of the slider component relative to the webbing, the effective length of the webbing can be adjusted. Ring and slider arrangements are well known and documented in the textile arts.

Seam: As used in this disclosure, a seam is a joining of: 1) a first textile to a second textile; 2) a first sheeting to a second sheeting; or, 3) a first textile to a first sheeting.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Shirt: As used in this disclosure, a shirt is any item of apparel that is worn on or over the shoulders of a wearer such that a force applied to the item of apparel in a direction of the foot of the wearer will not disrobe the wearer of the item of apparel.

Stay: As used in this disclosure, a stay is a rope, line, cord, or strap that is used to steady, guide, hold, or secure an object. A common synonym for stay is guy line.

Strap: As used in this disclosure a strap is a strip of leather, cloth, or other flexible material, often with a buckle, that is used to fasten, secure, carry, or hold onto something.

Strip: As used in this disclosure, the term describes a long and narrow object of uniform thickness that appears thin relative to the length of the object. Strips are often rectangular in shape.

Textile: As used in this disclosure, a textile is a material that is woven, knitted, braided or felted. Synonyms in common usage for this definition include fabric and cloth.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips.

Yarn: As used in this disclosure, a yarn is continuous strand of textile fibers and filaments. Yarns are generally used in the production of fabrics. For the purposes of this disclosure, this definition explicitly includes yarns formed from a single filament such as a monofilament yarn.

With respect to the above description, it is to be realized that the optimum dimensional relationship for the various components of the invention described above and in FIGS. 1 through 3, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A garter comprising:

a plurality of stays;

wherein each of the plurality of stays further comprises a first strap, a second strap, and a quick release buckle;

wherein the garter is adapted for use with a shirt;

wherein the garter is adapted for use with a wearer;

wherein the garter holds the shirt in position while it is worn by a wearer;

wherein the garter is worn underneath the outer layer of apparel of the wearer;

wherein the garter attaches the shirt of the wearer to one or more feet of the wearer;

wherein the quick release buckle attaches the first strap to the second strap;

wherein the plurality of stays comprises a first stay and a second stay;

wherein the first stay is placed around the right foot of the wearer;

wherein the second stay is placed around the left foot of the wearer;

wherein the first strap is a webbing;

wherein the second strap is a webbing;

wherein the first strap is further defined with a first end and a second end;

wherein the second strap is further defined with a third end and a fourth end;

wherein the quick release buckle further comprises a male connector and a female connector;

wherein the quick release buckle further comprises a ring and slider arrangement;

wherein the first end of the first strap is folded back upon the body of the first strap such that a loop is formed;

wherein the first end is attached to the body of the first strap using a seam;

wherein the loop is sized such that the loop will receive the foot of the wearer;

wherein the second end of the first strap attaches to a first member selected from the group consisting of the male connector of the quick release buckle and the female connector of the quick release buckle;

wherein the first member is the element of the group consisting of the male connector of the quick release buckle and the female connector of the quick release buckle that contains the ring and slider arrangement of the quick release buckle;

wherein the ring and slider arrangement adjusts the effective length of the first strap to a length such that a tension is applied to the first strap while the garter is being worn;

wherein the second strap further comprises a second member, a first clip and a second clip;

wherein the second member, a first clip and a second clip attach to the second strap;

wherein the second member is the element of the group consisting of the male connector of the quick release buckle and the female connector of the quick release buckle that was not selected to be the first member;

wherein the second member is attached to the second strap such that the position of the second member is adjustable such that the second member can be positioned anywhere along the second strap.

2. The garter according to claim 1 wherein the first clip attaches to the third end of the second strap;

wherein the second clip attaches to the fourth end of the second strap.

3. The garter according to claim 2 wherein the first clip attaches to the shirt;

wherein the second clip attaches to the shirt.

4. The garter according to claim 3 wherein the plurality of stays further comprises a first stay and a second stay;

wherein the first stay is placed over the right foot such that the first stay is under the heel of the right foot;

wherein the second stay is placed over the right foot such that the second stay is under the heel of the left foot.

5. The garter according to claim 1 wherein the first strap is formed from an elastic webbing;

wherein the second strap is formed from an elastic webbing.

6. The garter according to claim 5 wherein the first clip attaches to the third end of the second strap;

wherein the second clip attaches to the fourth end of the second strap.

7. The garter according to claim 6 wherein the first clip attaches to the shirt;

wherein the second clip attaches to the shirt.

8. The garter according to claim 7 wherein the plurality of stays further comprises a first stay and a second stay;

wherein the first stay is placed over the right foot such that the first stay is under the heel of the right foot;

wherein the second stay is placed over the right foot such that the second stay is under the heel of the left foot.

* * * * *